US008333523B2

(12) United States Patent
Asada

(10) Patent No.: US 8,333,523 B2
(45) Date of Patent: Dec. 18, 2012

(54) RECORDING DEVICE WITH LINK MECHANISM CONFIGURED TO LINK PATH CHANGING UNIT TO FEED ROLLER ARM

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/413,341

(22) Filed: Mar. 6, 2012

(65) Prior Publication Data

US 2012/0162338 A1 Jun. 28, 2012

Related U.S. Application Data

(62) Division of application No. 12/054,333, filed on Mar. 24, 2008, now Pat. No. 8,152,391.

(30) Foreign Application Priority Data

Mar. 29, 2007 (JP) ..... 2007-089469

(51) Int. Cl.

| | |
|---|---|
| ***B41J 3/60*** | (2006.01) |
| ***B41J 13/00*** | (2006.01) |
| ***B65H 3/06*** | (2006.01) |
| ***B65H 15/00*** | (2006.01) |
| ***B65H 85/00*** | (2006.01) |

(52) U.S. Cl. ..... 400/188; 271/9.07; 271/9.11

(58) Field of Classification Search ..... 400/149, 400/188; 399/401; 271/9.07, 9.08, 9.11, 271/3.14, 291, 65, 186

See application file for complete search history.

(56) References Cited

U.S. PATENT DOCUMENTS

| | | | | |
|---|---|---|---|---|
| 4,699,503 | A | 10/1987 | Hyltoft | |
| 5,030,991 | A | 7/1991 | Zaitsu et al. | |
| 6,659,444 | B2 | 12/2003 | Kawarama | |
| 6,909,872 | B2 | 6/2005 | Eskey | |
| 7,725,071 | B2 | 5/2010 | Izuchi et al. | |
| 8,152,391 | B2 * | 4/2012 | Asada | 400/188 |
| 2005/0194732 | A1 | 9/2005 | Asada | |
| 2006/0214357 | A1 | 9/2006 | Westhoff | |
| 2006/0268089 | A1 | 11/2006 | Takeuchi | |
| 2007/0081199 | A1 | 4/2007 | Koga et al. | |
| 2007/0122225 | A1 | 5/2007 | Izuchi et al. | |

FOREIGN PATENT DOCUMENTS

JP H08-268652 A 10/1996

(Continued)

OTHER PUBLICATIONS

Japan Patent office, Notice of Reasons for Rejection for Japanese Patent Application No. 2007-089469 (counterpart to co-pending U.S. Appl. No. 12/054,333), mailed Aug. 25, 2009.

*Primary Examiner* — Daniel J Colilla
(74) *Attorney, Agent, or Firm* — Baker Botts L.L.P.

(57) ABSTRACT

A recording device includes a feed tray for storing sheets, a first conveying path, an arm having one end attached to a pivot, and a roller attached to the other end of the arm. The roller feeds the sheet to the first conveying path. A recording unit is positioned in the first conveying path, and records an image onto the sheet. The recording device also includes a second conveying path between the pivot and the feed tray, and a path changing unit. The path changing unit moves between a first position, where it discharges the sheet, and a second position, where it conveys the sheet to the second conveying path. The arm moves between a third position where the roller contacts the sheets in the feed tray, and a fourth position where the roller is above the second conveying path.

7 Claims, 11 Drawing Sheets

FOREIGN PATENT DOCUMENTS

| | | | |
|---|---|---|---|
| JP | H11-079566 | A | 3/1999 |
| JP | H11-209008 | A | 8/1999 |
| JP | 2003-226053 | A | 8/2003 |
| JP | 2004-170942 | A | 6/2004 |
| JP | 2005-247521 | A | 9/2005 |
| JP | 2006-327793 | A | 12/2006 |
| JP | 2007-062965 | A | 3/2007 |
| JP | 2007-145574 | A | 6/2007 |

* cited by examiner

RECORDING DEVICE WITH LINK MECHANISM CONFIGURED TO LINK PATH CHANGING UNIT TO FEED ROLLER ARM

CROSS-REFERENCE TO RELATED APPLICATION

The present application is a divisional application of U.S. patent application Ser. No. 12/054,333, filed on Mar. 24, 2008, which claims the benefit of Japanese Patent Application No. 2007-089469, filed on Mar. 29, 2007, the disclosures of which are incorporated herein.

BACKGROUND OF THE INVENTION

1. Field of the Invention

The present invention relates to a recording device that records images on both sides of a sheet.

2. Description of Related Art

Known inkjet printers have a duplex printing function for recording images on both sides of a recording sheet. Known inkjet printers discharge ink onto the recording sheet from a recording head when the recording sheet is conveyed along a conveying path. This causes an image to be recorded on one side of the recording sheet. Then the recording sheet is conveyed in the reverse direction, is flipped over, and is conveyed to an upstream side of the recording head in the conveying path. When the recording sheet passes the recording head, an image is recorded on the other side of the recording sheet. Then, the recording sheet having the image recorded on the other side is discharged to a discharge tray from the conveying path.

A known image recording device, e.g., the known image recording device described in Japanese Unexamined Patent Application Publication No. 2006-327793, is provided with a feed roller at an end of an arm that is swingable in a direction in which it moves closer to or away from a feed tray. Recording sheets held in the feed tray are fed one at a time to a U-turn conveying path when the feed roller is rotationally driven while being in contact with the recording sheets. The recording sheet is fed to a straight conveying path through the U-turn conveying path.

From its trailing edge, the recording sheet having the image recorded on one side is guided to a location. A driven roller that comes into contact with and separates from the feed roller is disposed above the feed roller. The feed roller and the driven roller are rotationally driven while they nip the recording sheet, which is guided by a reverse feed path disposed above the swingable arm, to the location. This causes the recording sheet to be fed to the U-turn conveying path. An image is recorded on the other side of the recording sheet when it passes the recording head in the conveying path. Then, the recording sheet having the image recorded on the other side is discharged to a discharge tray.

In another known image recording device, e.g., the image recording device described in Japanese Unexamined Patent Application Publication No. 2003-226053, a structure in which a recording sheet having an image recorded on one side is conveyed in a reverse direction to a feed tray, and is fed again to a conveying path by a feed roller. In the feed tray, a placement plate where recording sheets are placed is biased upward by a coil spring. Therefore, the recording sheets held in the feed tray are pressed by the feed roller disposed above the feed tray. In this state, the feed roller is rotationally driven, causing the uppermost recording sheet to be fed from the feed tray to the conveying path.

An image is recorded on one side of the recording sheet when the recording sheet is conveyed along the conveying path. A downstream side of the recording unit in the conveying path and the feed roller are connected to each other by a reverse feed path. The recording sheet having the image recorded on one side is guided to the reverse feed path and is fed to a location between the feed tray and the feed roller. An image is recorded on the other side of the recording sheet fed again to the conveying path, when the recording sheet passes the recording unit. Then, the recording sheet having the images recorded on both sides is discharged to a discharge tray.

In a known inkjet recording device, the recording sheet having the image recorded on one side is conveyed in the reverse direction, such that the sheet returns to the location between the feed roller at an end of the swingable arm and the driven roller, which is disposed above the feed roller. Therefore, the height of the inkjet recording device may increase.

In another known inkjet recording device, the recording sheet having the image recorded on one side is conveyed in the reverse direction such that the sheet returns to the feed tray. Therefore, the recording sheet in the feed tray may be fed along with the sheet conveyed in the reverse direction. In addition, since the feed roller contacts one side of the recording sheet on which the image is recorded when again feeding the recording sheet to the conveying path, ink or toner may adhere to the feed roller from the recording sheet to be fed again.

SUMMARY OF THE INVENTION

Accordingly, in view of such problems, it is an object of the present invention to provide a thin duplex recording device in which a recording sheet having an image recorded on one side is fed again to the sheet conveying path without double-feeding another recording sheet in a feed tray and soiling the surface of a feed roller. In an embodiment of the invention, a recording device comprises a feed tray configured to store a plurality of sheets, a first conveying path configured to convey a sheet of the plurality of sheets in a first direction, an arm having a first end and a second end opposite the first end, and configured to swing around a predetermined pivot to which the first end is attached, a feed roller rotatably attached to the second end of the arm and configured to feed the sheet from the feed tray to the first conveying path, a recording unit disposed in the first conveying path and configured to record an image onto the sheet being conveyed in the first conveying path, a second conveying path disposed between the predetermined pivot and the feed tray, and configured to guide the sheet in a second direction, to an upstream side of the recording unit in the first conveying path, a path changing unit disposed at a downstream side of the recording unit in the first conveying path and configured to selectively move between a first position wherein the path changing unit is configured to discharge the sheet, and a second position wherein the path changing unit is configured to convey the sheet to the second conveying path. The arm is configured to selectively move between a third position wherein the feed roller contacts the sheets in the feed tray, and a fourth position wherein the feed roller is disposed above the second conveying path, and first direction is substantially opposite to the second direction.

DESCRIPTION OF THE PREFERRED EMBODIMENTS

For a more complete understanding of the invention, the needs satisfied thereby, and the objects, features, and advantages thereof, reference now is made to the following description taken in connection with the accompanying drawings.

Figure 1:
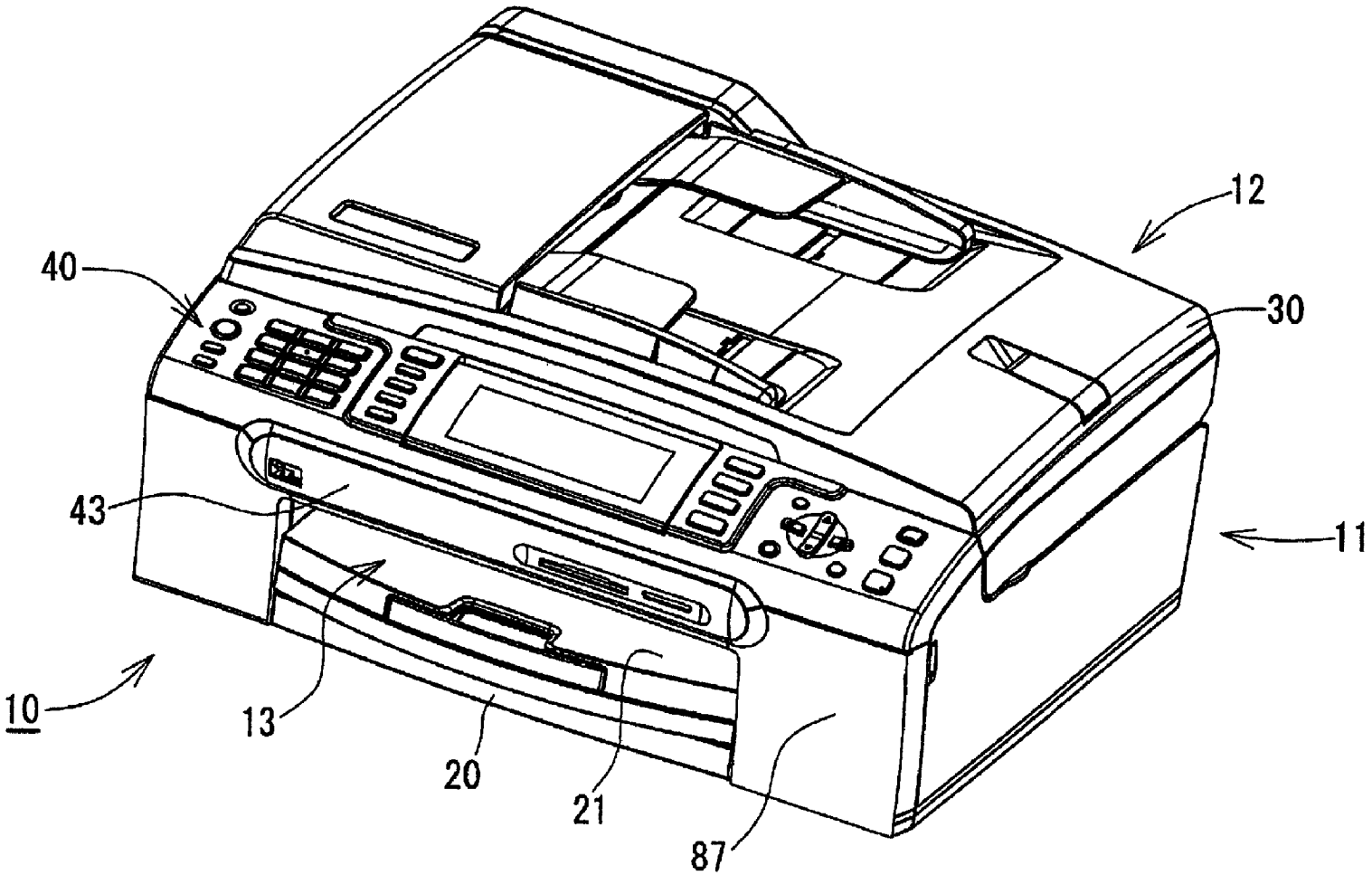
FIG. 1 is a perspective view of an external structure of a multi-function device according to an embodiment of the invention.

A recording device, e.g., a duplex recording device, e.g., a multi-function device 10, may, as shown in FIG. 1, have a printing unit 11 at a lower portion thereof, and a scanning unit 12 at an upper portion thereof. Multi-function device 10 may have multiple functions, e.g., a printing function, a scanning function, a copying function, and a facsimile function. Printing unit 11 may be a printer, e.g., an inkjet printer.

As shown in FIG. 1, multi-function device 10 may have a low-profile shape, and may have a width and a depth that are greater than its height. Multi-function device 10 may have a substantially rectangular, parallelepiped form. The upper portion of multi-function device 10 may correspond to scanning unit 12. Scanning unit 12 may comprise a flat bed scanner (FBS) and an automatic document feeder (ADF). As shown in FIG. 1, a document cover 30 may be disposed at a front cover of multi-function device 10 and may be configured to be opened and closed. The ADF may be disposed at the document cover 30. A platen glass (not shown) and an image sensor (not shown) may be disposed at the lower side of document cover 30. At scanning unit 12, the image sensor may read a document on the platen glass or a document conveyed by the ADF. The operation of scanning units is well known, and a detailed description of the operation of scanning unit 12 is omitted.

An operation panel 40 may be disposed at the upper portion of the front side of multi-function device 10 and may be configured to operate printing unit 11 and scanning unit 12. Operation panel 40 may comprise a display, e.g., a liquid crystal display (LCD), which may display various information, and input keys, which may be used to input information. Multi-function device 10 may operate based on input received from operation panel 40. In addition, multi-function device 10 may operate based on information that is transmitted from an outside source, e.g., a computer that is connected to multi-function device 10 via a network or other communications device, e.g., a LAN or a direct cable.

Multi-function device 10 may be disposed with a slot unit 43, which may be configured to receive and read memory cards. For example, when a user operates operation panel 40 while a memory card is loaded in the slot unit 43, image data stored in the memory card may be read out and recorded onto a recording sheet.

Figure 2:
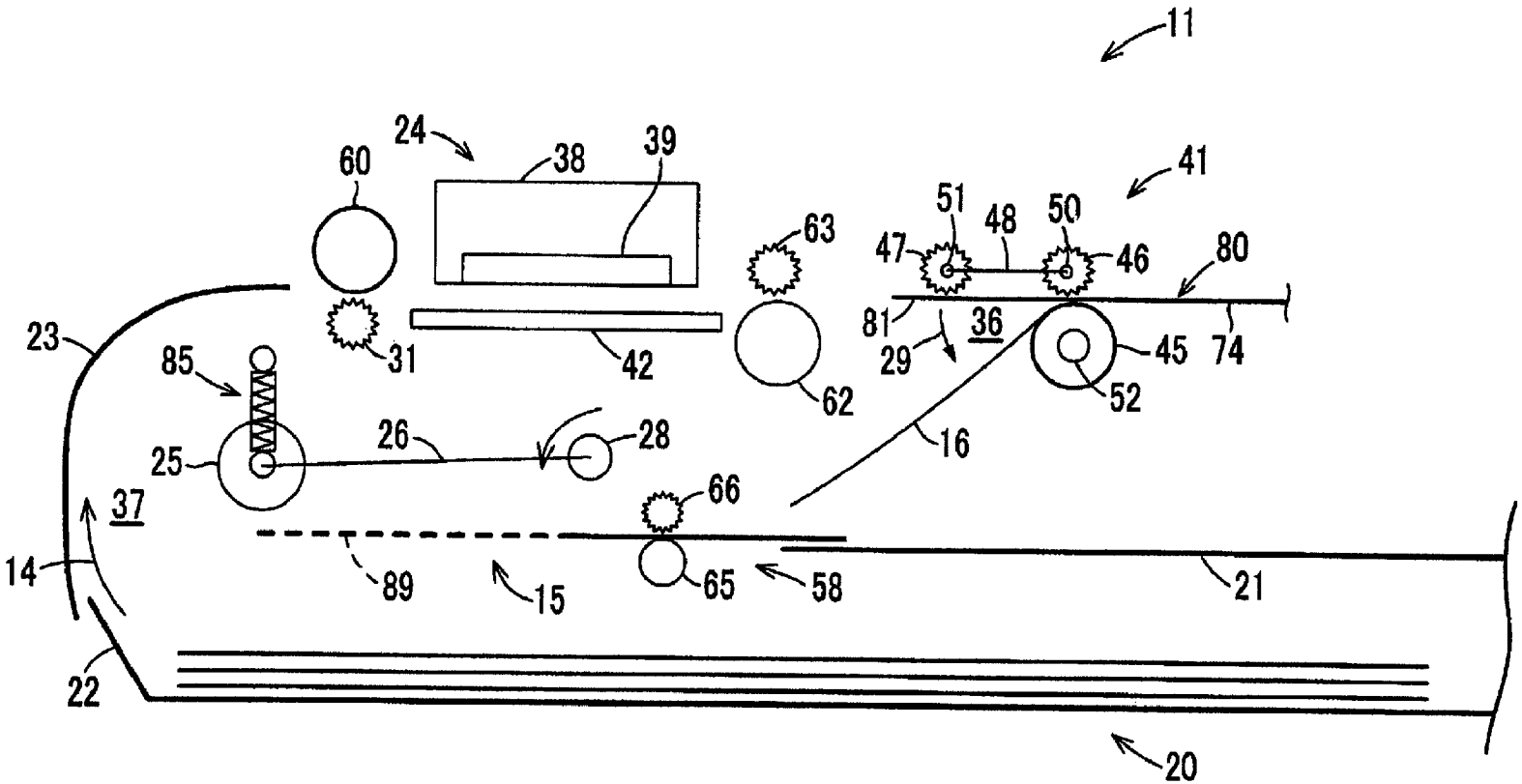
FIG. 2 is a schematic view of a structure of a printing unit according to an embodiment of the invention.

An internal structure of multi-function device 10, in particular, a structure of printing unit 11 is described herein. As shown in FIG. 1, a door 87 may be disposed at the lower right portion of the front side of printing unit 11, and configured to be opened and closed. A cartridge mount (not shown) may be disposed at the inner side of door 87. When door 87 is opened, the cartridge mount may be exposed at the front side of printing unit 11, which may allow an ink cartridge to be mounted and dismounted. As shown in FIG. 2, mounting the ink cartridge to the cartridge mount may cause an inkjet recording head 39 to be connected to the ink cartridge through an ink tube. Referring again to FIG. 1, in printing unit 11, ink supplied from the ink cartridge may be discharged onto a recording sheet by inkjet recording head 39, such that an image may be recorded onto the recording sheet.

As shown in FIG. 1, an opening 13 may be formed in the front side of printing unit 11. A feed tray 20 and a discharge tray 21 may be disposed in opening 13. Feed tray 20 and discharge tray 21 may be disposed vertically in two layers, and discharge tray 21 may be disposed above feed tray 20.

As shown in FIGS. 1 and 2, recording sheets may be placed in feed tray 20. Feed tray 20 may be disposed at the bottom of printing unit 11. The recording sheets in feed tray 20 may be fed into printing unit 11. As shown in FIG. 2, an inclined plate 22 may be disposed at the back side, e.g., the left side, when multi-function device 10 is disposed as shown in FIG. 2, of feed tray 20. Inclined plate 22 may be inclined towards the back side of the device. Inclined plate 22 may separate the topmost recording sheet from the rest of the sheets in feed tray 20, and may guide the topmost sheet upwards.

A first conveying path 23 may be disposed above inclined plate 22. First conveying path 23 may be a path for conveying the recording sheet, and may have an arcuate portion. First conveying path 23 may extend upwards from inclined plate 22, and then may curve towards the front side, e.g., the right side, when multi-function device 10 is disposed as shown in FIG. 2. First conveying path 23 then may extend towards the front side, may pass by a recording unit 24, and may be connected to discharge tray 21. The recording sheet in feed tray 20 may reverse direction, e.g., perform a U-turn upwards along first conveying path 23 and may reach recording unit 24. Then, recording unit 24 may record an image onto the recording sheet, and the recorded recording sheet may be discharged to discharge tray 21.

As shown in FIG. 2, a feed roller 25 may be disposed above feed tray 20. Feed roller 25 may press-contact the recording sheets in feed tray 20, and feed the topmost recording sheet to first conveying path 23. As shown in FIG. 2, feed roller 25 may be rotatably supported at an end of an arm 26. Feed roller 25 may be rotationally driven by a driving source, e.g., a motor (not shown).

Arm 26 may be supported at a pivot 28. This may allow arm 26 to swing around a pivotal center, e.g., pivot 28, in a direction in which arm 26 moves closer to or away from feed tray 20. The position of arm 26 may change from the third position to the forth position. As shown in FIG. 3B, when arm 26 is in the third position, feed roller 25 may contact recording sheets in feed tray 20. When arm 26 is in the fourth position, feed roller 25 may be positioned above a second conveying path 15. Arm 26 may be biased elastically by an urging member, e.g., a coil spring 85, such that arm 26 may move from the third position to the fourth position. One end of coil spring 85 may be fixed to a frame of printing unit 11 and the other end of coil spring 85 may be fixed to a shaft of feed roller 25. Arm 26 may be maintained in the fourth position due to an equilibrium reached between an elastic force of coil spring 85 and a gravitational force pulling arm 26 in a direction substantially towards tray 20.

When a driving force is transmitted from the motor to feed roller 25, arm 26 may change from the fourth position to the third position. As shown in FIG. 2, when a driving force is transmitted from the motor to pivot 28, pivot 28 may rotate in a counterclockwise direction. The counterclockwise rotation of pivot 28 may cause arm 26 to pivot towards feed tray 20, and may cause feed roller 25 to contact, e.g., press-contact, the recording sheets in feed tray 20, as shown in FIG. 3B. In this state, feed roller 25 may be rotationally driven in a clockwise direction. This may cause the topmost recording sheet in feed tray 20 to move towards inclined plate 22. An end of the recording sheet may contact inclined plate 22, and then may be guided upwards and into first conveying path 23 in the direction of arrow 14, as shown in FIG. 2. When the topmost recording sheet is sent out by feed roller 25, a recording sheet disposed directly below the topmost recording sheet also may be sent out due to friction or static electricity. Inclined plate 22 may contact and restrain this recording sheet.

First conveying path 23 may include an outer guide surface and an inner guide surface, and may exclude a portion where recording unit 24 is disposed. First conveying path 23 also may be defined by an outer guide member (not shown) and an inner guide member (not shown), which may be disposed opposite to each other at a predetermined interval. Freely rotatable rollers (not shown) may be disposed in a curved portion of first conveying path 23. Surfaces of rollers may be exposed from the outer guide member, which may allow the recording sheet to be conveyed smoothly in the curved portion of first conveying path 23.

As shown in FIG. 2, recording unit 24 may be disposed in first conveying path 23, and may record an image onto the recording sheet that is conveyed in first conveying path 23. Recording unit 24 may comprise a carriage 38 and inkjet recording head 39 which may be mounted to carriage 38. Carriage 38 may be configured to reciprocate in a main scanning direction, e.g., in a direction perpendicular to a plane formed by the sheet of FIG. 2. Ink may be supplied to inkjet recording head 39 through the ink tube from the ink cartridge. Very small ink droplets may be discharged from inkjet recording head 39 while carriage 38 reciprocates. This may cause an image to be recorded onto the recording sheet conveyed on a platen 42. Although the recording method of recording unit 24 described in this embodiment is an inkjet recording method, other embodiments of this invention are not limited to an inkjet recording method and may use other recording methods, e.g., an electrophotography method.

The reverse guide 16 may be connected to first conveying path 23, and may be formed continuously with a portion of first conveying path 23 situated at the downstream side of recording unit 24, e.g., with downstream portion 36. A path changing unit 41, which will be further described herein, may be disposed at downstream portion 36. Reverse guide 16 may comprise a reverse path for the guiding recording sheet, which may have an image recorded on one side thereof, towards multiple feed guide 29. As shown in FIG. 2, reverse guide 16 may extend obliquely downward towards multiple feed guide 29 from downstream portion 36. A recording sheet 74, having the image recorded on one side, may be guided by reverse guide 16 and a second conveying path 15, and may be conveyed to an upstream portion 37 in first conveying path 23. Recording sheet 74 may be conveyed in the direction of arrow 14 along first conveying path 23. When recording sheet 74 passes recording unit 24, an image may be recorded on the other side, e.g., the side opposite to the recorded side.

As shown in FIG. 2, a conveying roller 60 may be disposed at an upstream side in a recording-sheet conveying direction (hereinafter interchangeably referred to as the "upstream side") of recording unit 24 in first conveying path 23. A pinch roller 31 may be disposed at a position opposing conveying roller 60, with first conveying path 23 being disposed between rollers 31 and 60. Pinch roller 31 may be biased so as to press-contact conveying roller 60. The recording sheet fed to first conveying path 23 may advance to a position between conveying roller 60 and pinch roller 31. Conveying roller 60 and pinch roller 31 may nip this recording sheet and rotate, which may send the recording sheet onto platen 42.

As shown in FIG. 2, a discharge roller 62 may be disposed at a downstream side in the recording-sheet conveying direction (hereinafter interchangeably referred to as the "downstream side") of recording unit 24 in first conveying path 23. A spur roller 63 may be disposed at a position opposing discharge roller 62, with first conveying path 23 being disposed between rollers 62 and 63. Spur roller 63 may be biased such that it press-contacts discharge roller 62, and may be configured to press-contact a printed side of the recording sheet. The surface of spur roller 63 may be uneven, which may prevent deterioration of the image recorded on the recording sheet. Discharge roller 62 and spur roller 63 may nip the recording sheet that has passed platen 42, and rotate, which may convey the recording sheet to a downstream portion 36.

Conveying roller 60 and discharge roller 62 may be driven by the motor (not shown) for driving feed roller 25. Conveying roller 60 and discharge roller 62 may be synchronously and intermittently driven. The synchronous intermittent drive of conveying roller 60 and discharge roller 62 may cause the recording sheet to be fed by a predetermined line feed width. A rotary encoder (not shown) may be disposed at conveying roller 60. The rotary encoder may have an optical sensor configured to detect a pattern of an encoder disc (not shown) that may rotate with conveying roller 60. On the basis of a detection signal thereof, the rotation of conveying roller 60 and discharge roller 62 may be controlled.

In multi-function device 10, the motor may be a driving source for feeding the recording sheet to first conveying path 23 from feed tray 20, for conveying the recording sheet along first conveying path 23, and for discharging the recording sheet to discharge tray 21. The motor may drive feed roller 25, and conveying roller 60 and discharge roller 62.

As shown in FIG. 2, path changing unit 41 may be disposed at the downstream side of recording unit 24 in first conveying path 23. More specifically, path changing unit 41 may be disposed at downstream portion 36, which may act as a boundary between first conveying path 23 and reverse guide 16. Path changing unit 41 may comprise pairs of rollers 45, 46 opposing each other and also may comprise auxiliary rollers 47 which may be disposed in parallel with rollers 46. Rollers 46 and auxiliary rollers 47 may be mounted to a frame 48.

Frame 48 may extend in the widthwise direction of multi-function device 10, e.g., in a direction perpendicular to the sheet plane of FIG. 2.

Rollers 46 and auxiliary rollers 47 may be disposed at frame 48, at predetermined intervals in the widthwise direction of multi-function device 10. Rollers 46 and auxiliary rollers 47 may be supported by shafts 50 and 51, respectively, such that rollers 46 may be rotatable around shafts 50 and auxiliary rollers 47 may be rotatable around shafts 51. The axial directions of shafts 50 and 51 may be perpendicular to the sheet plane of FIG. 2. Since rollers 46 and auxiliary rollers 47 may come into contact with a recorded side 80 of recording sheet 74, they may have a spur shape, similar to the spur shape of spur roller 63. Auxiliary rollers 47 may be disposed a predetermined distance away from rollers 46 on an upstream side. Rollers 46 may be biased towards rollers 45 by an elastic member.

Rollers 45 may be rotated in the forward or reverse direction by the motor for driving feed roller 25, conveying roller 60, and discharge roller 62. Rollers 45 may be connected to the motor through a predetermined drive transmission mechanism (not shown). Rollers 45 may have a center shaft 52, which may be connected to the drive transmission mechanism. A predetermined bracket may be disposed at center shaft 52, and may be fastened to a device frame with, a fastening member, e.g., a screw, such that center shaft 52 may be supported by the device frame.

Rollers 46 may be placed on rollers 45, and instead of rollers 45, a single, elongated, cylindrical roller may be used. Rollers 46 may be disposed such that rollers 46 and rollers 45 oppose each other. Rollers 45 may be rotated in the forward or reverse direction by the motor. Recording sheet 74 conveyed along first conveying path 23 may be nipped by rollers 45 and rollers 46. As shown in FIG. 1, when rollers 45 rotate in the forward direction, recording sheet 74 may be nipped by rollers 45 and rollers 46, may be conveyed downstream, and may be discharged to discharge tray 21. When rollers 45 rotate in the reverse direction, recording sheet 74 may be nipped by rollers 45 and rollers 46, and may be returned to the upstream side.

Figure 3A:
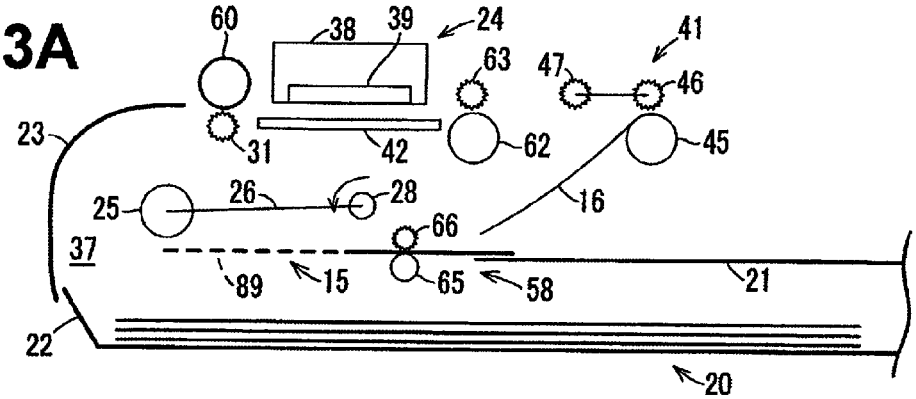
FIGS. 3A to 3D are schematic views showing duplex recording in a printing unit according to an embodiment of the invention.
Figure 3B:
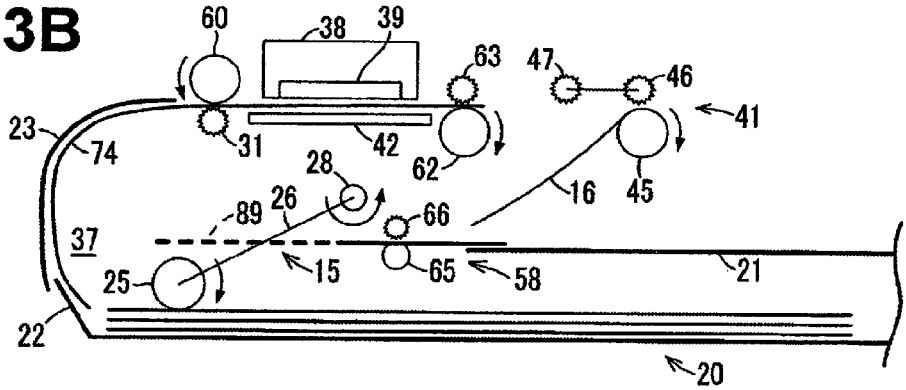
Figure 3C:
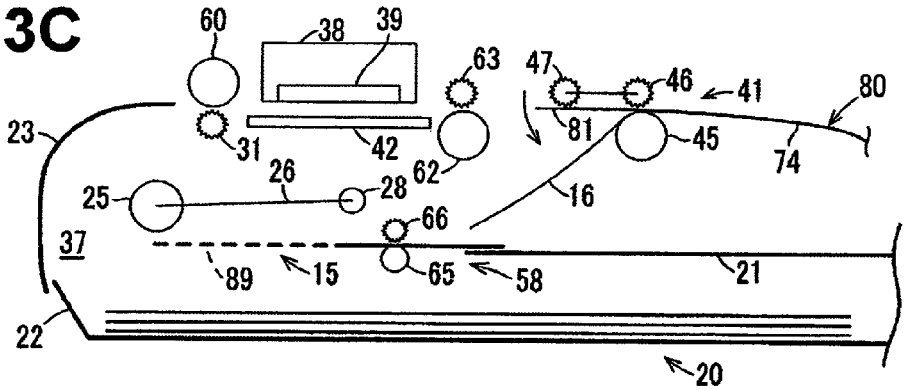
Figure 3D:
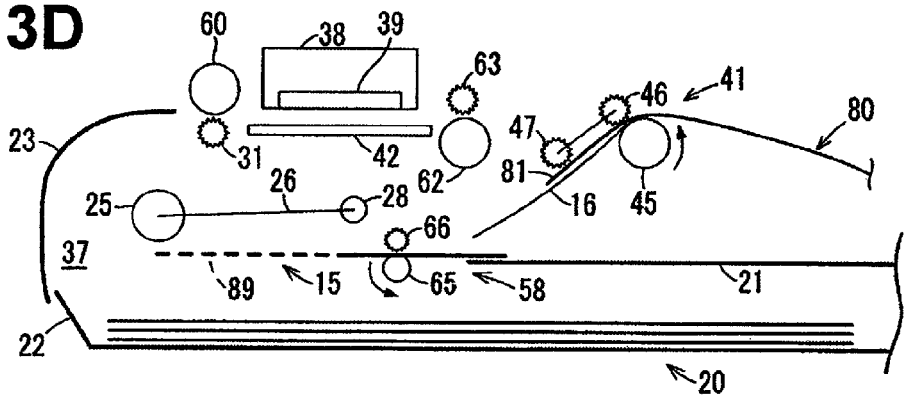

As shown in FIGS. 3D, path changing unit 41 may be formed such that frame 48, rollers 46, and auxiliary rollers 47 may rotate together in the direction of arrow 29, around center shaft 52. The motor may transmit a driving force which may cause path changing unit 41 to change its position between a first position and a second position. As shown in FIG. 2, when path changing unit 41 is in the first position, recording sheet 74 that has passed recording unit 24 may be discharged to discharge tray 21. When path changing unit 41 is in the second position, recording sheet 74 that has passed recording unit 24 may be conveyed in the reverse direction to second conveying path 15 through reverse guide 16, as shown in FIG. 3D.

Rollers 45 may be rotated in the forward direction by the motor, while path changing unit 41 may be maintained in the first position. In particular, rollers 45 may rotate clockwise when rollers 45 are in a state shown in FIG. 2. This rotation may cause recording sheet 74 that has passed recording unit 24 to be sent towards discharge tray 21, e.g., towards the right as shown in FIG. 2. While rollers 45 and rollers 46 nip a trailing edge 81 of recording sheet 74, the position of path changing unit 41 may change from the first position to the second position. As shown in FIG. 3D, by this change in position, trailing edge 81 of recording sheet 74 may be pressed downward by auxiliary rollers 47. Rollers 45 may be rotated in the reverse direction by the motor while path changing unit 41 is maintained in the second position. In particular, rollers 45 may be rotated counterclockwise when the rollers are in the state shown in FIG. 3D. This reverse rotation may cause recording sheet 74 that has passed recording unit 24 to be guided towards reverse guide 16 from its trailing edge 81, and to be conveyed, in the reverse direction, to second conveying path 15.

Second conveying path 15 may be a path for guiding the recording sheet 74 that has passed the recording unit 24 to the upstream side of the recording unit 24 in the first conveying path 23, e.g., to the upstream portion 37. As shown in FIG. 2, second conveying path 15 may be disposed between the feed tray 20 and the pivot 28, and may be configured to connect the reverse guide 16 and the upstream portion 37. Second conveying path 15 may be defined by a plate-shaped guide member 89 that covers the top side of feed tray 20. Guide member 89 may be separated from the recording sheets in feed tray 20. Recording sheet 74, guided from reverse guide 16, may be conveyed in the reverse direction along the top side of guide member 89. Guide member 89 may be secured to discharge tray 21. Arm 26 may be configured to pivot in a direction which allows arm 26 to move closer to or away from feed tray 20. Further, arm 26 may be disposed between feed tray 20 and pivot 28. Although not shown, a portion of the guide member 89 through which the arm 26 and the feed roller 25 pass may be cut away, which may result in guide member 89 having a substantially concave shape when viewed in a plan view.

A roller pair 58, may be disposed at guide member 89, and may comprise a roller 65 and a roller 66 which oppose each other. The surface of roller 65 may be exposed to the upper side of guide member 89. Freely rotatable roller 66 may be disposed above roller 65. Roller 66 may be biased such that roller 66 may press-contact roller 65. Since roller 66 press-contacts recorded side 80 of recording sheet 74, the surface of roller 66 may have an uneven, e.g., a spur, form, which may prevent deterioration of an image recorded on recording sheet 74. Rollers 65 and 66 nip recording sheet 74, which has been redirected from the reverse guide 16, and rotate. This rotation causes recording sheet 74 to be fed from second conveying path 15 to the upstream side of recording unit 24 in first conveying path 23, e.g., to the upstream portion 37. Roller 65 is driven by the motor for driving feed roller 25, conveying roller 60, and discharge roller 62.

In FIGS. 3A to 3D and 4A to 4C, the coil spring 85 is not shown. In an embodiment of the invention, printing unit 11 performs single-side recording. As shown in FIGS. 3A and 3B, when an instruction to start printing is given by a predetermined operation on the operation panel 40, driving force may be transmitted from the motor to pivot 28. This driving force may cause arm 26 to move from the fourth position to the third position. The movement of arm 26 may cause coil spring 85 to expand, which may cause coil spring 85 to build elastic force for pivoting the arm 26 upward. While arm 26 is in the third position, the motor rotationally drives feed roller 25. As shown in FIG. 3B, when the motor rotationally drives feed roller 25, the topmost recording sheet held in feed tray 20 may be fed to first conveying path 23.

After feed roller 25 feeds the recording sheet from feed tray 20 to first conveying path 23, feed roller 25 may stop. While the motor rotationally drives feed roller 25, arm 26 may be pivoted towards feed tray 20 by the driving force transmitted from the motor to the feed roller 25. When the feed roller 25 is stopped, the elastic force stored in the coil spring 85 may cause the arm 26 to move from the third position to the fourth position.

The recording sheet fed to the first conveying path 23 from the feed tray 20 may be conveyed along first conveying path 23 by conveying roller 60 and pinch roller 31, and discharge roller 62 and spur roller 63. While the recording sheet is conveyed along the first conveying path, an image may be recorded on one side of the recording sheet by recording unit 24. In the single-side recording mode, the rollers 45 and 46 rotate in a direction which feeds the recording sheet towards the right side of the image recording device as positioned in FIG. 3B. In an embodiment of the invention, in single-side recording mode, roller 45 may rotate clockwise and roller 46 may rotate counterclockwise, and path changing unit 41 may be maintained in the first position. This configuration may cause recording sheet 74, having the image recorded on one side, to be discharged to discharge tray 21 from first conveying path 23.

In the duplex recording mode, rollers 45 and 46 may rotate clockwise and counterclockwise, respectively, while path changing unit 41 may be maintained in the first position, which may allow recording sheet 74, having the image recorded on one side, to be discharged to discharge tray 21. In duplex mode, when trailing edge 81 of recording sheet 74 reaches the state shown in FIG. 3C, e.g., when trailing edge 81 reaches a predetermined position that may be located upstream from the auxiliary rollers 47, the path changing unit 41 may move from the first position, as shown in FIG. 3C, to the second position, as shown in FIG. 3D. As shown in FIG. 3D, when path changing unit is in the second position, trailing edge 81 of recording sheet 74 may be pressed downward by auxiliary rollers 47, and may be redirected towards the reverse guide 16.

Figure 4A:
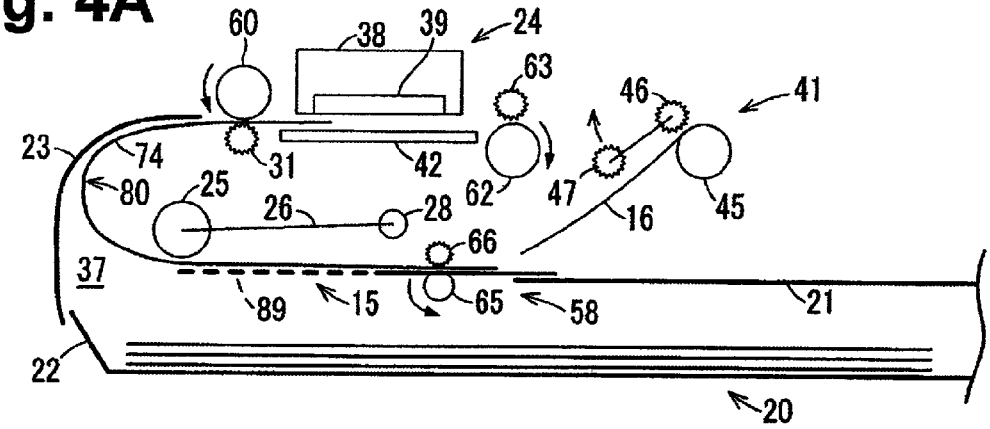
FIGS. 4A to 4C are schematic views showing the duplex recording in the printing unit according to an embodiment of the invention.

By reversing rotation of rollers 45 and 46, recording sheet 74 may be conveyed in the reverse direction, to the reverse guide 16 and the second conveying path 15, as shown in FIGS. 3D and 4A. Since arm 26 may be maintained in the fourth position, second conveying path 15, e.g., the upper surface of guide member 89, may be freed from arm 26 and feed roller 25. Recording sheet 74, conveyed in the reverse direction to second conveying path 15, may be nipped by rollers 65 and 66, and may be fed from second conveying path 15 to the upstream side of recording unit 24 in first conveying path 23.

Figure 4B:
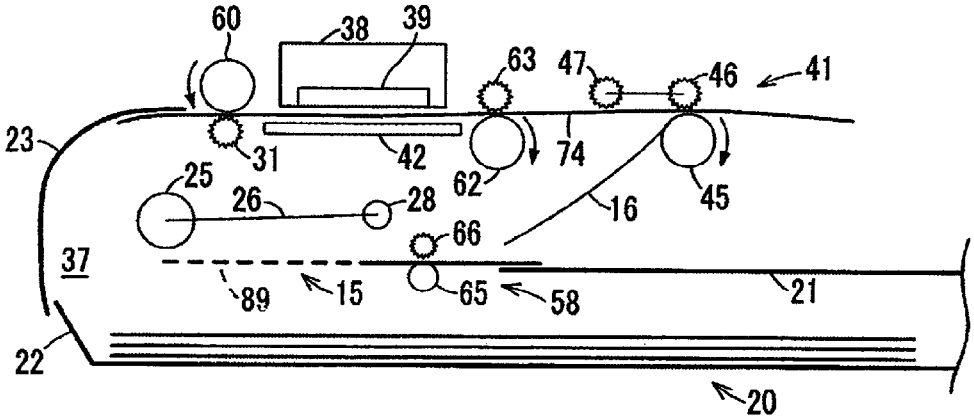
Figure 4C:
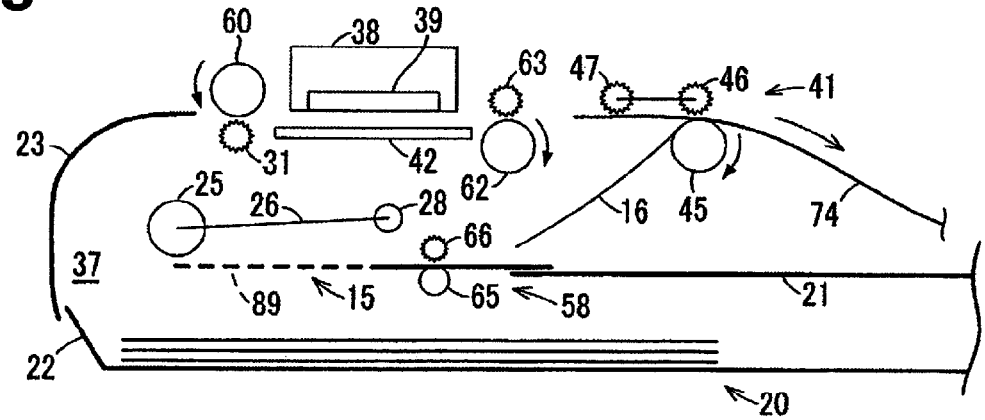

This may cause recording sheet 74 to flip, e.g., to change the side of recording sheet 74 that faces upward. When recording sheet 74 is conveyed on platen 42, a side of recording sheet 74 that is opposite to recorded side 80 may oppose inkjet recording head 39. When recording sheet 74 moves on platen 42, an image may be recorded on the opposite side, e.g., the side opposite to the recorded side 80. When recording sheet 74 is conveyed from second conveying path 15 to first conveying path 23, the position of path changing unit 41 may change from the second position, as shown in FIG. 4A, to the first position, as shown in FIG. 4B. Recording sheet 74, which now may have images recorded on both sides, may be discharged from first conveying path 23 to discharge tray 21, by forward rotation of rollers 45 and 46.

In printing unit 11, second conveying path 15 may be disposed between feed tray 20 and pivot 28 of arm 26. Therefore, multi-function device 10 may be reduced in size. In the duplex recording mode, the recording sheet 74 may be conveyed in the reverse direction along second conveying path 15 to the upstream side of recording unit 24 in first conveying path 23, without being returned to the feed tray 20, which may reduce the incidence of unintentionally feeding both recording sheet 74 that is conveyed in the reverse direction and the topmost recording sheet in feed tray 20.

Recording sheet 74 may be conveyed to upstream portion 37 from second conveying path 15 by rollers 65 and 66. Recording sheet 74 again may be fed to the upstream side of recording unit 24 in first conveying path 23 without using feed roller 25. Therefore, it is possible to decrease the occurrence of ink on recorded side 80 of recording sheet 74 adhering to feed roller 25.

FIGS. 5A to 5D and FIGS. 6A to 6D describe printing according to another embodiment of the invention. In another embodiment of the invention, multi-function device 10 may have the same structure as described in the above embodiment, except that multi-function device 10 may not have coil spring 85, and multi-function device 10 may have a arm link member 53. Parts that are common to those described in the above embodiment will not be further described herein.

Figure 5A:
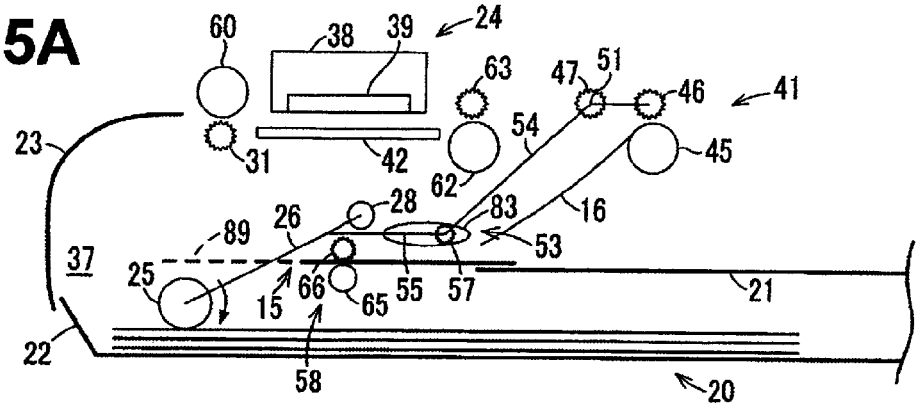
FIGS. 5A to 5D are schematic views showing duplex recording in a printing unit according to another embodiment of the invention.

In multi-function device 10 according to another embodiment, arm 26 may be rotationally biased towards a feed tray 20 by gravitational force acting upon arm 26 and feed roller 25. As shown in FIG. 5A, arm 26 may be maintained in a third position. Printing unit 11 may comprise arm link member 53, which may link a path changing unit 41 and arm 26, such that a positional change of one of the path changing unit 41 and the arm 26 may cause a positional change of the other. Arm link member 53 may comprise a link arm 54, a link arm 55, and a link shaft 57. Link shaft 57 may link the link arms 54 and 55 to each other, such that they are capable of pivoting. Link shaft 57 may be a roller having an uneven outer peripheral surface, e.g., in the form of a spur. Link shaft 57 may be slidable, and may be formed such link shaft 57 may have a sliding direction restricted to a horizontal direction, e.g., a right-left direction as shown in FIGS. 5A to 6D. Sliding of link shaft 57 may be restricted by a guide groove 83.

One end of link arm 54 may be connected to a shaft 51 of auxiliary rollers 47, and the other end of link arm 54 may be connected to link shaft 57. One end of link arm 55 may be connected to arm 26, and the other end of link arm 55 may be connected to the link shaft 57. Therefore, path changing unit 41 and arm 26 may be linked to each other by link arm 54, link shaft 57, and link arm 55.

Figure 5B:
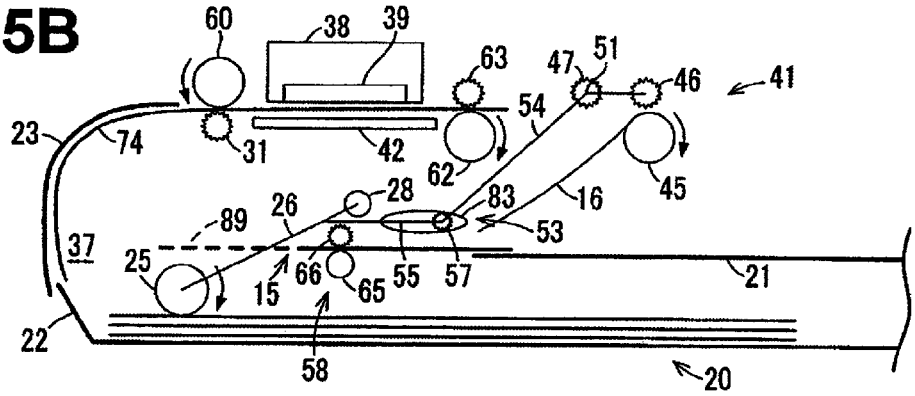
Figure 5C:
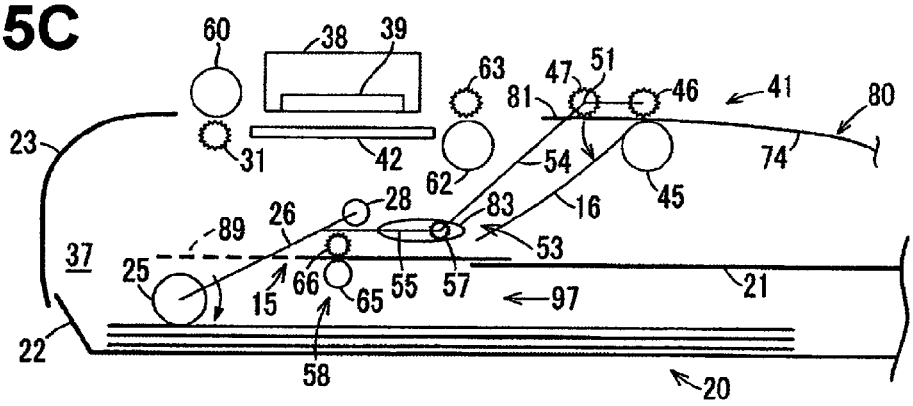

As shown in FIG. 5A, feed roller 25 may be rotationally driven while it press-contacts a topmost recording sheet held in the feed tray 20. This may cause the recording sheet to be fed from the feed tray 20 towards a first conveying path 23, as shown in FIGS. 5A and 5B. Recording unit 24 may record an image on one side of the recording sheet when the recording sheet is conveyed along the first conveying path 23. Rollers 45 and 46 may rotate forwardly, e.g., in a direction which may cause the recording sheet to be conveyed towards the right side of printing unit 11 when the multi-function device is oriented as shown in FIG. 5A, while the path changing unit 41 may be maintained in a first position. This may cause recording sheet 74, which now may have the image recorded on one side, to be conveyed towards a discharge tray 21, as shown in FIGS. 5B and 5C. Then, when a trailing edge 81 of recording sheet 74 reaches a predetermined position, e.g., a position that is situated upstream from auxiliary rollers 47, as shown in FIG. 5C, the position of path changing unit 41 may change from the first position to a second position, as shown in FIGS. 5C and 5D.

When path changing unit 41 moves from the first position to the second position, the arm 26 may change from the third position to the fourth position. The change in the position of path changing unit 41 may cause link shaft 57 to slide in the direction of arrow 97, which may result in link arm 55 moving in the direction of arrow 97. As link arm 55 moves in the direction of arrow 97, link arm 55 pushes a bottom side of arm 26 such that arm 26 swings upward, and the position of arm 26 changes from a third position to a fourth position, as shown in FIGS. 5C and 5D.

Figure 5D:
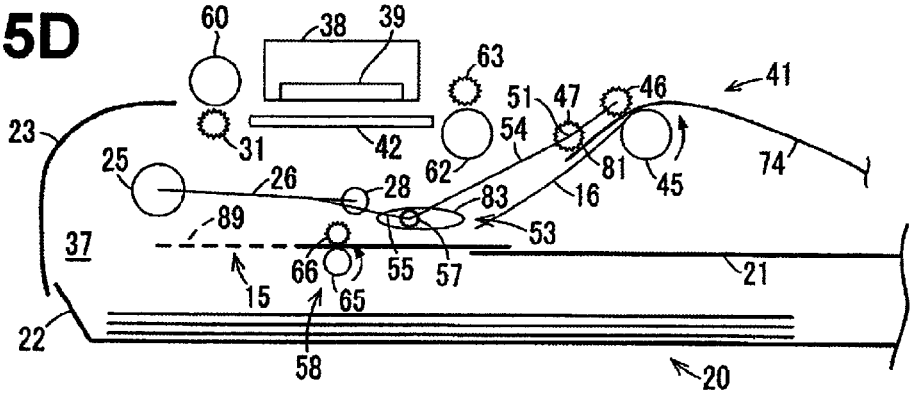
Figure 6A:
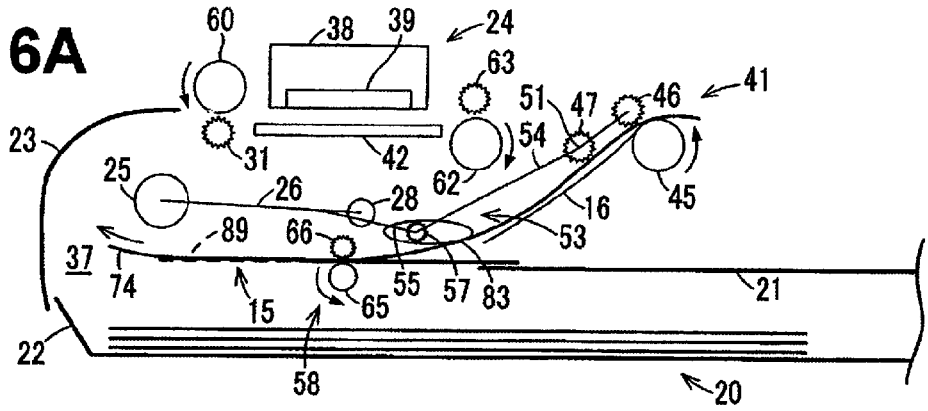
FIGS. 6A to 6D are schematic views showing the duplex recording in the printing unit according to another embodiment of the invention.

When path changing unit 41 changes from the first position to the second position, trailing edge 81 of recording sheet 74 may be pressed downward by auxiliary rollers 47, and may be directed towards a reverse guide 16, as shown in FIGS. 5C and 5D. Rollers 45 and 46 may rotate in a reverse direction, e.g., in a direction which may cause the recording sheet to be conveyed towards the left side of printing unit 11 when the multi-function device is oriented as shown in FIG. 5A. Rollers 45 and 46, rotating in a reverse direction, may change the conveying direction of recording sheet 74, such that recording sheet 74 may be conveyed to the reverse guide 16 and a second conveying path 15, in a reverse direction from the original direction in which recording sheet 74 was conveyed, as shown in FIGS. 5D and 6A.

Figure 6B:
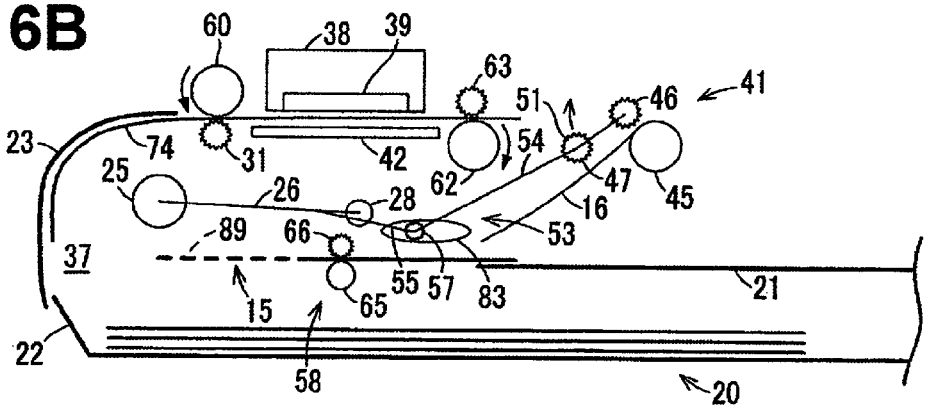

Arm 26 and feed roller 25, which may be maintained in the fourth position, may be freed from second conveying path 15, e.g., the upper surface of the guide member 89. Recording sheet 74 may be conveyed in the reverse direction to second conveying path 15, may be nipped by the rollers 65 and 66, and may be fed from second conveying path 15 to an upstream side of recording unit 24 in first conveying path 23, as shown in FIGS. 6A and 6B. This movement may cause recording sheet 74 to flip, e.g., to change the side of recording sheet 74 that faces upward. Recording sheet 74 then may be fed again to recording unit 24, such that an image may be recorded on the opposite side, e.g., the side opposite to a recorded side 80, of recording sheet 74.

Figure 6C:
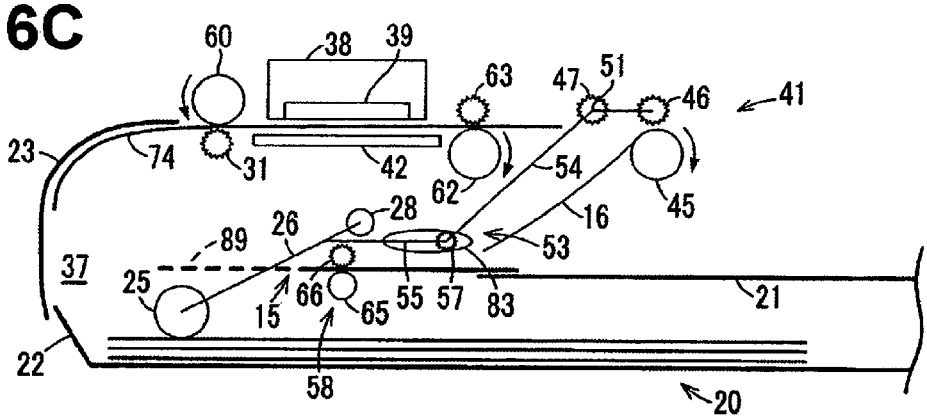
Figure 6D:
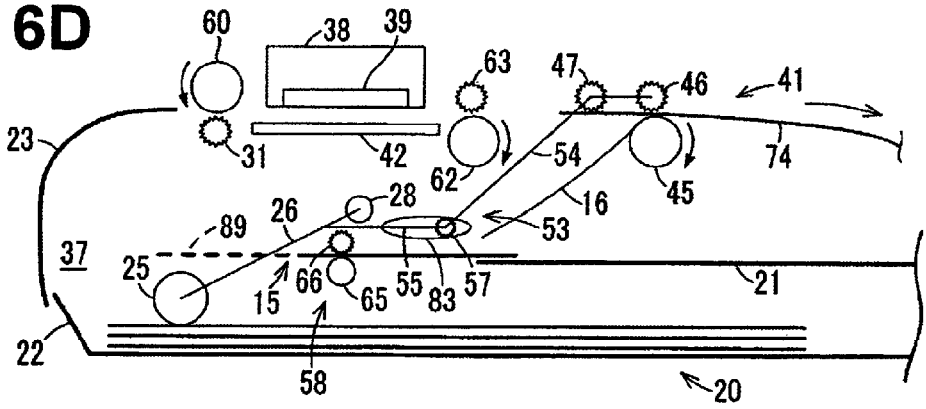

After recording sheet 74 is sent out from second conveying path 15 to first conveying path 23, path changing unit 41 may change from the second position to the first position, as shown in FIGS. 6B and 6C. The positional change of path changing unit 41 may cause link member 53 to move, which may cause arm 26 to change positions from the fourth position to the third position. Recording sheet 74, now having the images recorded on both sides, may be discharged from first conveying path 23 to discharge tray 21 by forward rotation of the rollers 45 and 46, as shown in FIG. 6D.

As described above, when path changing unit 41 changes position, arm 26 also may change position. Therefore, a driving source for changing the position of the path changing unit 41 and a driving source for changing the position of the arm 26 may be the same unit and may not be required to be separately provided.

A multi-function device 10 according to another embodiment of the invention has the same structure as the embodiment described immediately above, except that this embodiment may have a path link member 72 and a second conveying path 68, and may not have link member 53 or second conveying path 15. Other parts that may be common to those described in the above embodiments will not be described below.

In an embodiment of the invention, printing unit 11 may include a second conveying path 68, which may be provided with a guide member 56. Guide member 56 may be slidably provided at a discharge tray 21 such that guide member 56 may slide along a feed tray 20, which may allow guide member 56 to move closer to or further away from an upstream side of a recording unit 24 in a first conveying path 23, e.g., in a right-left direction as shown in FIG. 7. Guide member 56 may be substantially rectangular when viewed in plan view, and may not have a cutaway portion for guide member 89.

Figure 7A:
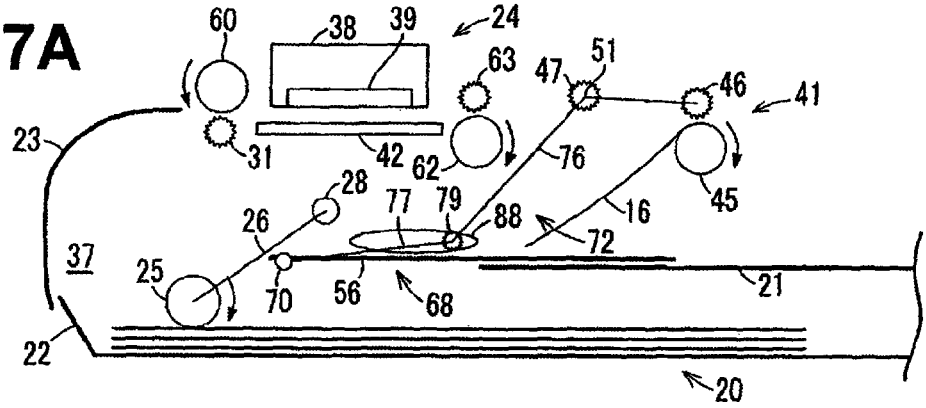
FIGS. 7A to 7D are schematic views showing duplex recording in a printing unit according to yet another embodiment of the invention.
Figure 7B:
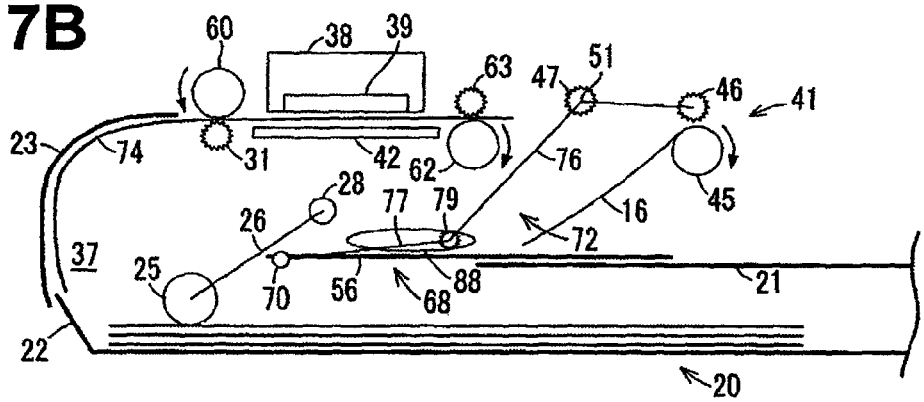
Figure 7C:
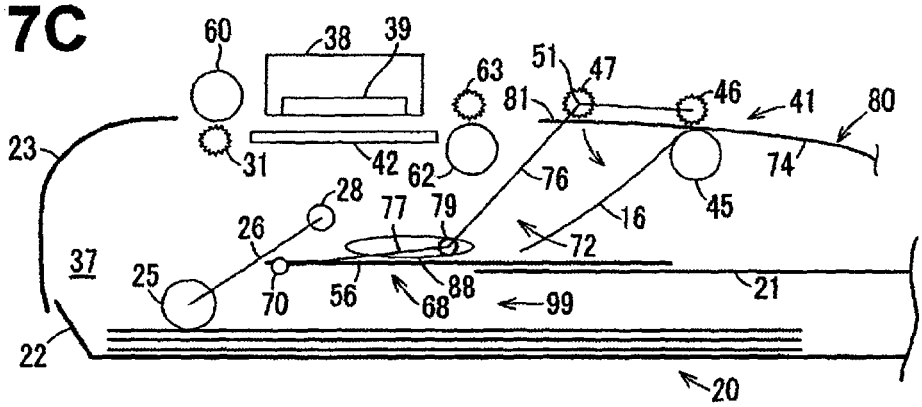
Figure 7D:
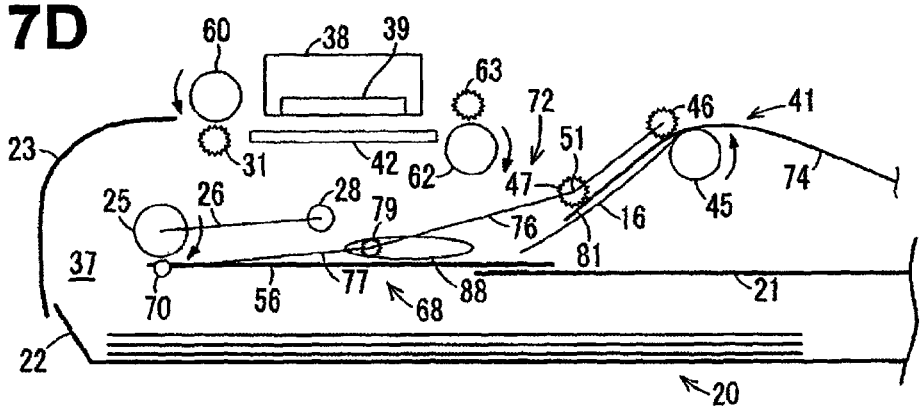

When guide member 56 slides, guide member 56 may cause second conveying path 68 to move closer to or further away from arm 26. When guide member 56 is separated from arm 26, arm 26 may be maintained in a third position. When guide member 56 slides toward the upstream side, e.g., the left side when printing unit 11 is oriented as shown in FIG. 7A, guide member 56 may contact arm 26 of recording unit 24 in first conveying path 23, and may cause arm 26 to swing. Arm 26 then may rotate upward, and may change from the third position to a fourth position, as shown in FIGS. 7C and 7D.

A guide roller 70, may be disposed at guide member 56. Guide roller 70 may be rotatable around a shaft which may extend horizontally in a direction substantially perpendicular to the sliding direction of guide member 56. The surface of guide roller 70 may be exposed to the upper surface of guide member 56. While arm 26 is maintained in the fourth position, guide roller 70 may be disposed such that guide roller 70 opposes feed roller 25, as shown in FIG. 7D. Guide roller 70 and feed roller 25 may nip a recording sheet 74 guided to second conveying path 68, and then may feed recording sheet 74 to the upstream side of recording unit 24 in first conveying path 23.

Printing unit 11 may be provided with path link member 72. Path link member 72 may link a path changing unit 41 and second conveying path 68, which may include guide member 56, such that a positional change of one of the path changing unit 41 and the second conveying path 68 may cause a positional change of the other. Path link member 72 may comprise a link arm 76, a link arm 77, and a link shaft 79. Link shaft 79 may link the link arms 76 and 77 to each other such that they may pivot. Link shaft 79 may be a roller having an uneven outer peripheral surface, e.g., in the form of a spur. Link shaft 79 may be formed such that link shaft 79 may be slidable. Further, a guide groove 88 may restrict the sliding movement of link shaft 79 to the right-left direction, as shown in FIGS. 7A to 8D.

One end of link arm 76 may be connected to a shaft 51 of auxiliary rollers 47, and the other end of link arm 76 may be connected to link shaft 79. One end of link arm 77 may be connected to the shaft of guide roller 70, disposed at guide member 56, and the other end of link arm 77 may be connected to link shaft 79. Accordingly, path changing unit 41 and second conveying path 68 may be linked to each other by the link arm 76, the link shaft 79, and the link arm 77.

As shown in FIG. 7A, feed roller 25 may be rotationally driven while it press-contacts a topmost recording sheet held in the feed tray 20. This may causes the recording sheet to be fed from the feed tray 20 towards first conveying path 23, as shown in FIGS. 7A and 7B. Recording unit 24 may record an image on one side of the recording sheet when the recording sheet is conveyed along first conveying path 23. Rollers 45 and 46 may rotate forwardly, e.g., in a direction which may cause the recording sheet to be conveyed towards the right side of printing unit 11 when the multi-function device is oriented as shown in FIG. 7A, while the path changing unit 41 may be maintained in a first position, as shown in FIG. 7B.

This may cause the recording sheet 74, which now may have the image recorded on one side, to be conveyed towards a discharge tray 21, as shown in FIGS. 7B and 7C. Then, when a trailing edge 81 of recording sheet 74 reaches a predetermined position, e.g., a position that is situated upstream from auxiliary rollers 47, as shown in FIG. 7C, the position of path changing unit 41 may change from the first position to a second position, as shown in FIGS. 7C and 7D.

When path changing unit 41 moves from the first position to the second position, link shaft 79 may slide in the direction of arrow 99, as shown in FIG. 7C. This may cause link arm 77 also to move in the direction of arrow 99, such that guide member 56 of second conveying path 68 may slide in the direction of arrow 99. As guide member 56 slides, it may cause arm 26 to swing. As a result, arm 26 may change from the third position to the fourth position, as shown in FIGS. 7C and 7D.

When path changing unit 41 moves from the first position to the second position, guide member 56 may slide in a direction such that guide member 56 moves closer to the upstream side of recording unit 24 in first conveying path 23, e.g., in the direction of arrow 99. As guide member 56 continues to slide, guide member 56 may contact arm 26, and arm 26 may change from the third position to the fourth position. Feed roller 25 may be supported by the guide roller 70, which may allow arm 26 to stay in the fourth position.

Figure 8A:
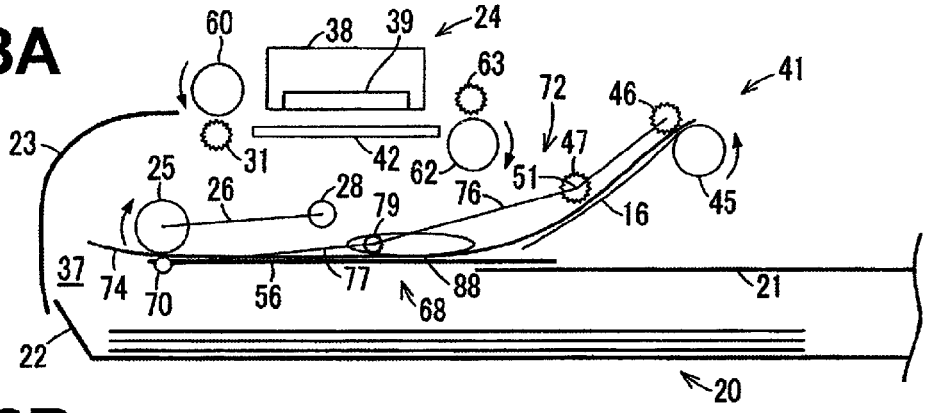
FIGS. 8A to 8D are schematic views showing the duplex recording in the printing unit according to yet another embodiment of the invention.

When path changing unit 41 changes from the first position to the second position, trailing edge 81 of recording sheet 74 may be pressed downward by auxiliary rollers 47, and may be directed towards a reverse guide 16, as shown in FIGS. 7C and 7D. Rollers 45 and 46, rotating in a reverse direction, may change the conveying direction of recording sheet 74, such that recording sheet 74 may be conveyed to the reverse guide 16 and a second conveying path 15, in a reverse direction from the original direction in which recording sheet 74 was conveyed, as shown in FIGS. 7D and 8A.

Figure 8B:
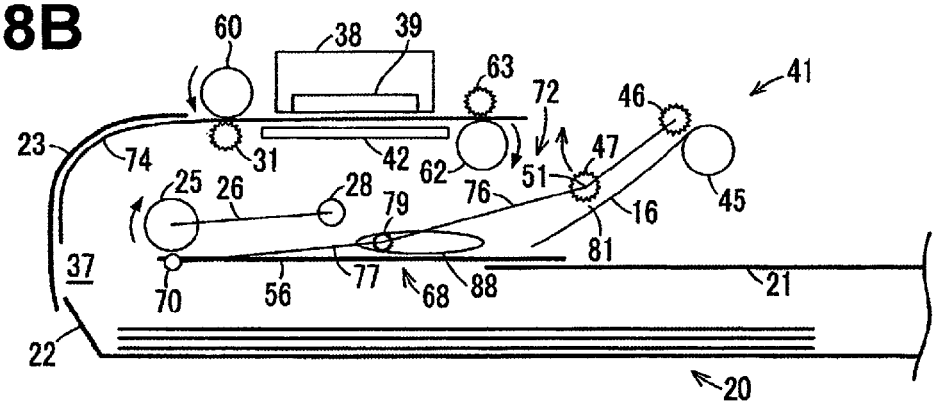

Recording sheet 74, now conveyed in the reverse direction to the second conveying path 68, may be nipped by feed roller 25 and guide roller 70, and may be fed to the upstream side of the recording unit 24 in first conveying path 23, e.g., an upstream portion 37. This movement may cause recording sheet 74 to flip, e.g., to change the side of recording sheet 74 that faces upward. Recording sheet 74 then may be fed again to recording unit 24, such that an image may be recorded on the opposite side, e.g., the side opposite to a recorded side 80, of recording sheet 74, as shown in FIG. 8B.

Figure 8C:
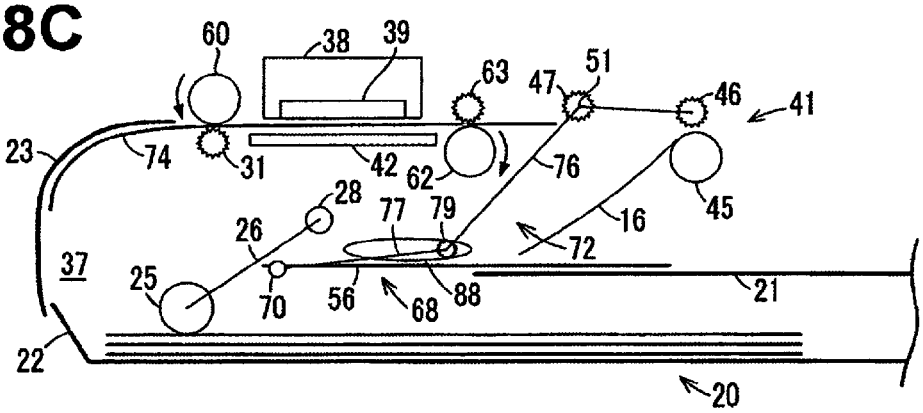
Figure 8D:
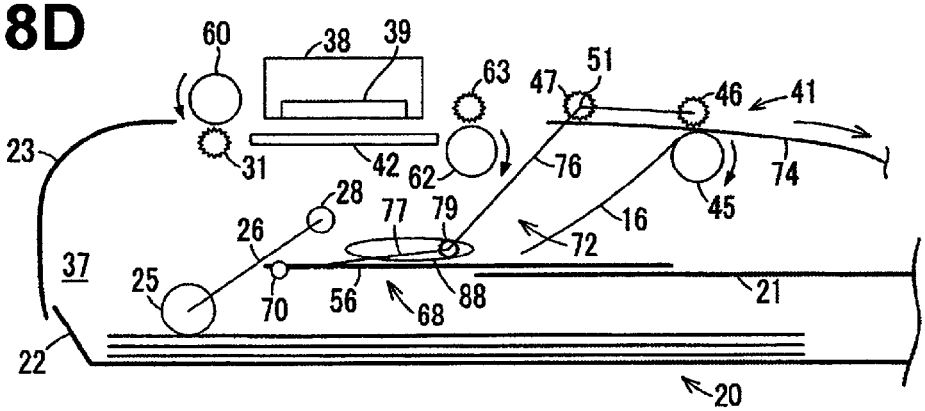

After recording sheet 74 is sent out from second conveying path 68 to first conveying path 23, path changing unit 41 may change from the second position to the first position. The positional change of path changing unit 41 may cause guide member 56 move, and to separate from arm 26, such that the arm 26 changes from the fourth position to the third position, as shown in FIGS. 8B and 8C. Recording sheet 74, now having the images recorded on both sides, may be discharged from first conveying path 23 to discharge tray 21 by forward rotation of rollers 45 and 46, as shown in FIG. 8D.

When arm 26 is maintained in the fourth position, recording sheet 74, conveyed in the second conveying path 68, may be nipped by feed roller 25 and guide roller 70, and may be fed to the upstream side of recording unit 24 in first conveying path 23. A picking force of feed roller 25 with respect to recording sheets 74 conveyed in the second conveying path 68 may be weaker than that when feed roller 25 is pivoted downward and arm 26 is in the third position. Therefore, an adherence of ink to feed roller 25 from recorded side 80 of recording sheet 74 may be reduced.

Guide roller 70 may be disposed at the guide member 56, and may act to smoothly and stably convey recording sheet 74 from second conveying path 68 to the upstream side of recording unit 24 in first conveying path 23.

In still another embodiment, multi-function device 10 has a similar structure as described above. Multi-function device 10 features may have a supply roller 98, at an arm 26. Other parts that are common to those described above will not be repeated herein.

Roller 98 may be rotatably supported at arm 26 such that roller 98 may be positioned closer to a pivot 28 than feed roller 25. Transmission gears 91 to 95 may be disposed at arm 26, between pivot 28 and supply roller 98. Transmission gear 95 may be disposed between supply roller 98 and feed roller 25. Additional gears may be disposed at the shafts of feed roller 25 and supply roller 98. The gear of supply roller 98 may engage transmission gears 94 and 95, and the gears of feed roller 25 may engage transmission gear 95. Driving force transmitted from the motor to pivot 28 may be transmitted to supply roller 98 through transmission gears 91 to 94, and may be transmitted to feed roller 25 through transmission gear 95. This may cause the motor to drive feed roller 25 and supply roller 98, and may cause the motor to rotate feed roller 25 and supply roller 98 in the same direction.

Figure 9A:
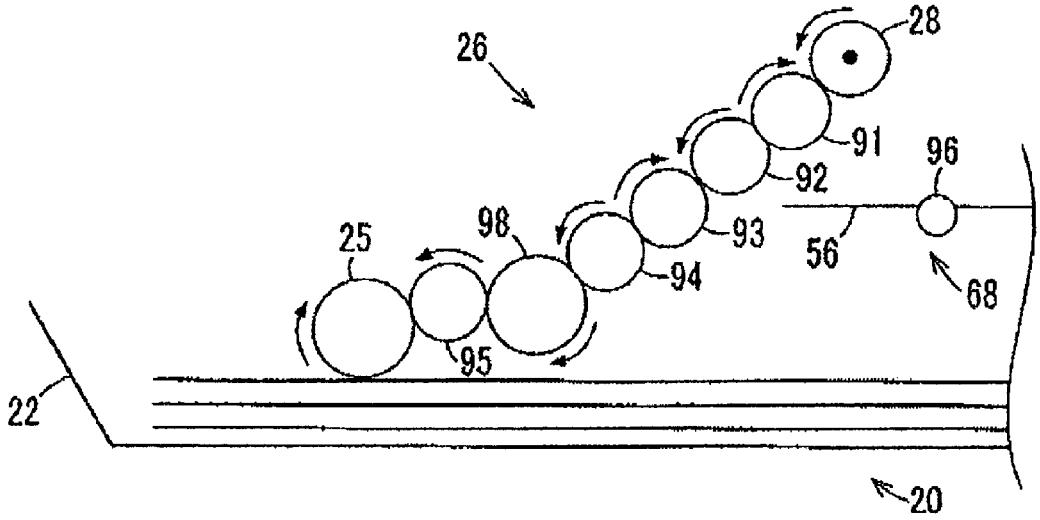
FIGS. 9A and 9B are schematic views showing a relationship between a feed roller and a supply roller, which may be disposed at an arm, according to an embodiment of the invention.
Figure 9B:
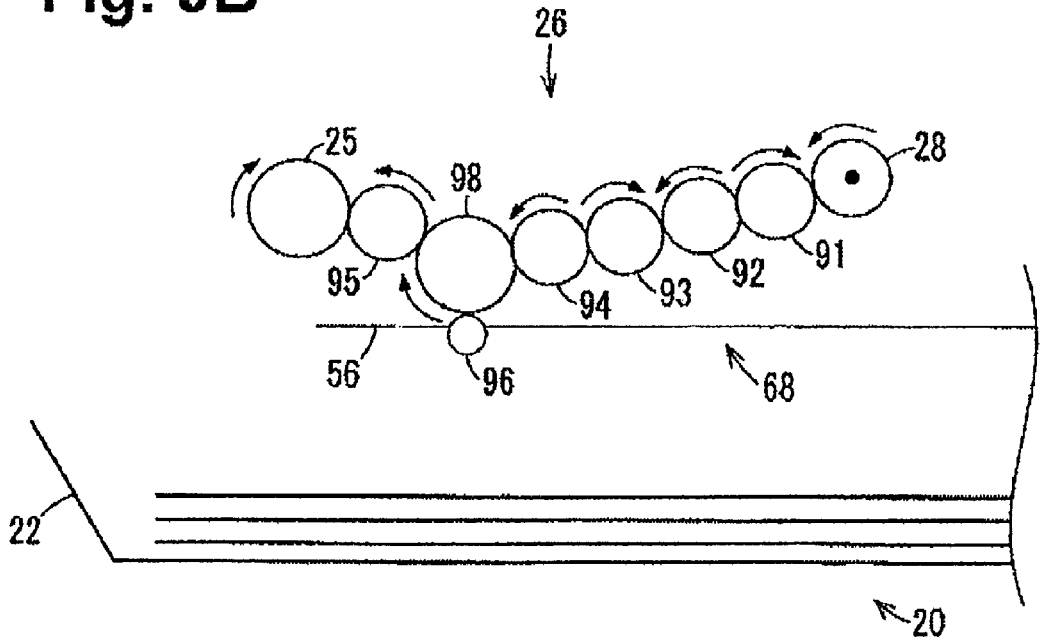

As shown in FIG. 9A, while arm 26 is in a third position, the surface of supply roller 98 may be disposed above feed roller 25. While arm 26 is maintained in the third position, supply roller 98 may avoid contacting a topmost recording sheet in feed tray 20. The topmost sheet from feed tray 20 may be fed to a first conveying path 23 by the feed roller 25. As shown in FIG. 9B, while the arm 26 is maintained in a fourth position, the surface of the supply roller 98 may be disposed closer to second conveying path 68 than feed roller 25. While arm 26 is maintained in the fourth position, the feed roller 25 may avoid contacting the recording sheet that is conveyed in the reverse direction along second conveying path 68. A recording sheet may be fed from second conveying path 68 to an upstream side of a recording unit 24 in first conveying path 23 by supply roller 98.

A supply guide roller 96, may be disposed at a guide member 56 in second conveying path 68. While arm 26 may be maintained in the fourth position, supply guide roller 96 may be disposed such that supply guide roller 96 may oppose supply roller 98.

Supply guide roller 96 may have substantially the same structure as guide roller 70, but its position at guide member 56 may differ from the position of guide roller 70, as shown in FIG. 7D. While arm 26 is maintained in the fourth position, supply guide roller 96 and supply roller 98 may feed the recording sheet guided in second conveying path 68 to the upstream side of recording unit 24 in first conveying path 23. Supply roller 98 and supply guide roller 96 rotate while nipping the recording sheet, conveyed in the reverse direction to the second conveying path 68, to feed the recording sheet to the upstream side of recording unit 24 in first conveying path 23.

Figure 10A:
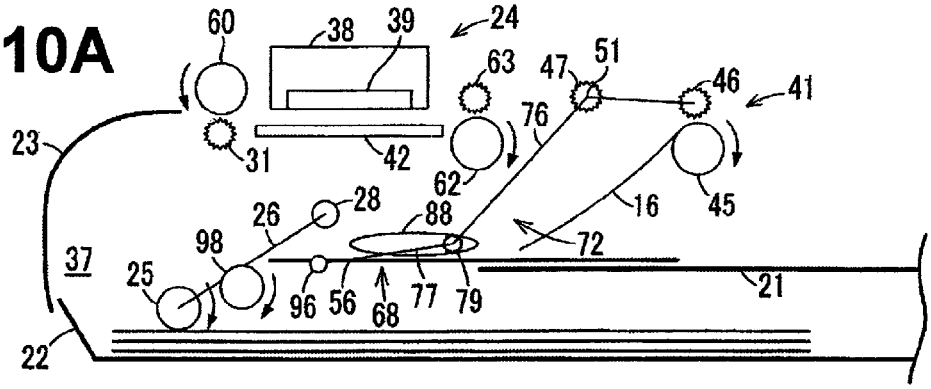
FIGS. 10A to 10D are schematic views showing duplex recording in a printing unit according to still another embodiment of the invention.
Figure 10B:
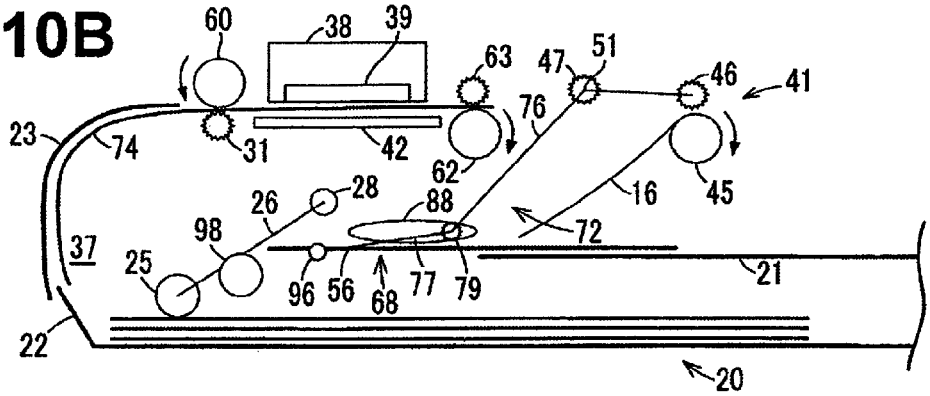

In an embodiment of the invention, one end of a link arm 77 may be connected to a shaft of the supply guide roller 96, and the other end of link arm 77 may be connected to a link shaft 79. As shown in FIG. 10A, feed roller 25 may be rotationally driven while it press-contacts a topmost recording sheet held in feed tray 20. This may cause the recording sheet to be fed from feed tray 20 towards first conveying path 23, as shown in FIGS. 10A and 10B. Recording unit 24 may record an image on one side of the recording sheet when the recording sheet is conveyed along the first conveying path 23. Rollers 45 and 46 may rotate forwardly, e.g., in a direction which may cause the recording sheet to be conveyed towards the right side of printing unit 11 when the multi-function device is oriented as shown in FIG. 5A, while the path changing unit 41 may be maintained in a first position.

Figure 10C:
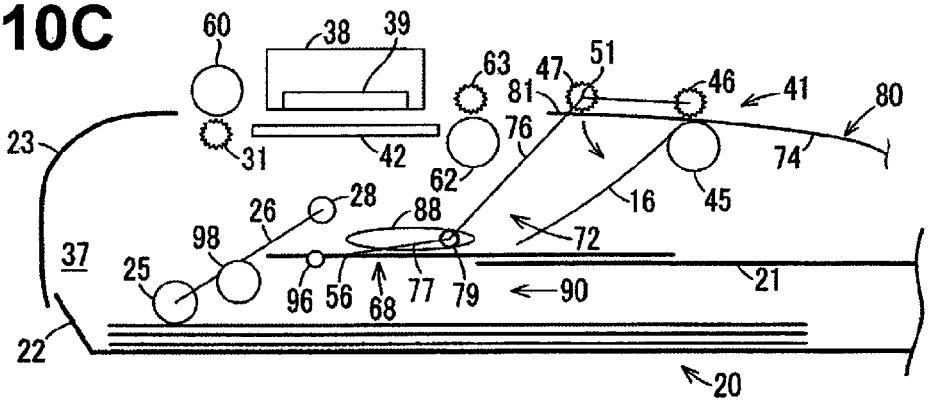

This may cause recording sheet 74, which now may have the image recorded on one side, to be conveyed towards a discharge tray 21, as shown in FIGS. 10B and 10C. When a trailing edge 81 of the recording sheet 74 reaches a predetermined position, e.g., a position that is situated upstream from auxiliary rollers 47, as shown in FIG. 10C, the position of path changing unit 41 may change from the first position to a second position, as shown in FIGS. 10C and 10D.

When path changing unit 41 moves from the first position to the second position, link shaft 79 may slide in the direction of arrow 90, as shown in FIG. 10C. Link arm 77 then may move in the direction of arrow 90, such that guide member 56 of second conveying path 68 may slides in the direction of arrow 90. As guide member 56 continues to slide, guide member 56 may contact arm 26, and arm 26 may change from the third position to the fourth position, as shown in FIGS. 10C and 10D. Supply roller 98 may be supported by supply guide roller 96, which may allow arm 26 to stay in the fourth position.

Figure 10D:
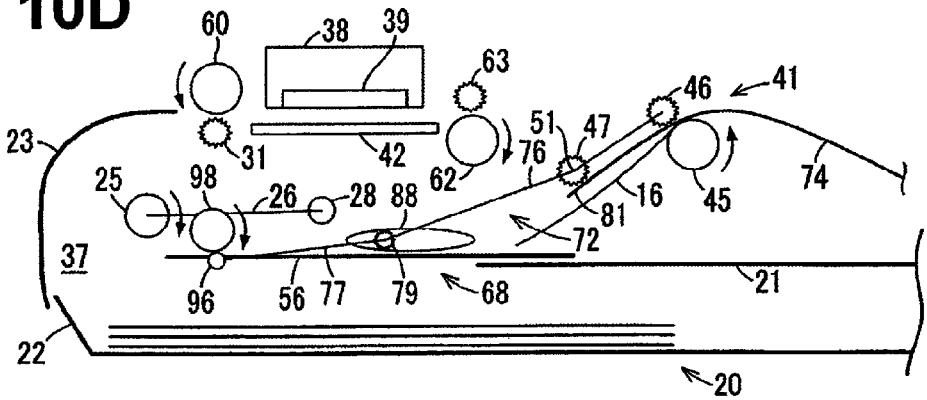
Figure 11A:
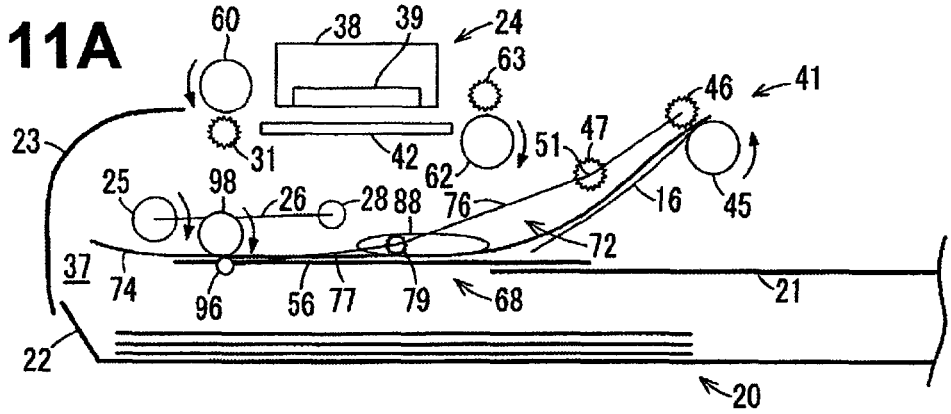
FIGS. 11A to 11D are schematic views showing the duplex recording in the printing unit according to still another embodiment of the invention.

When path changing unit 41 changes from the first position to the second position, trailing edge 81 of recording sheet 74 may be pressed downward by auxiliary rollers 47, and may be directed towards a reverse guide 16, as shown in FIG. 10D. Rollers 45 and 46, rotating in a reverse direction, may change the conveying direction of recording sheet 74, such that recording sheet 74 may be conveyed to the reverse guide 16 and a second conveying path 68, in a reverse direction from the original direction in which recording sheet 74 was conveyed, as shown in FIGS. 10D and 11A.

Recording sheet 74, now conveyed in the reverse direction to second conveying path 15, may be nipped by supply roller 98 and supply guide roller 96, and may be fed from second conveying path 68 to the upstream side of recording unit 24 in first conveying path 23. This movement may cause recording sheet 74 to flip, e.g., to change the side of recording sheet 74 that faces upward. Recording sheet 74 then may be fed again to recording unit 24, such that an image may be recorded on the opposite side, e.g., the side opposite to a recorded side 80, of recording sheet 74.

Figure 11B:
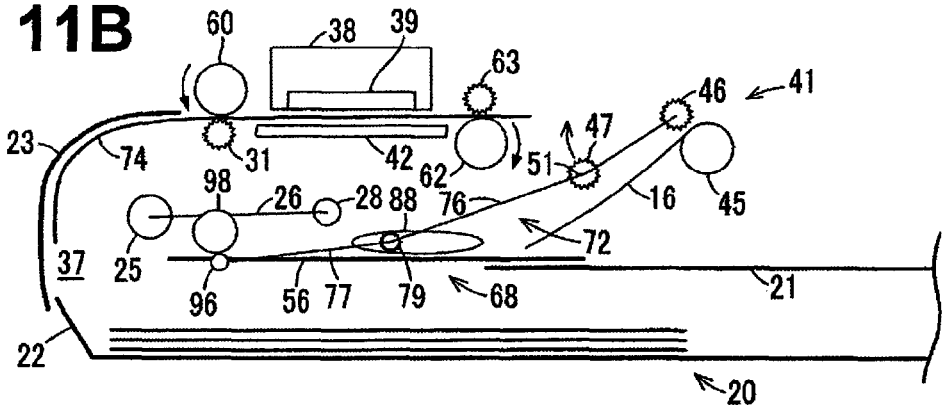
Figure 11C:
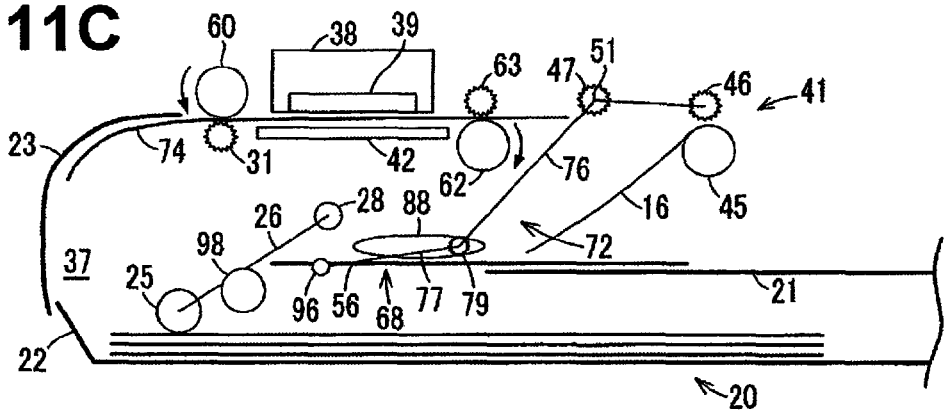
Figure 11D:
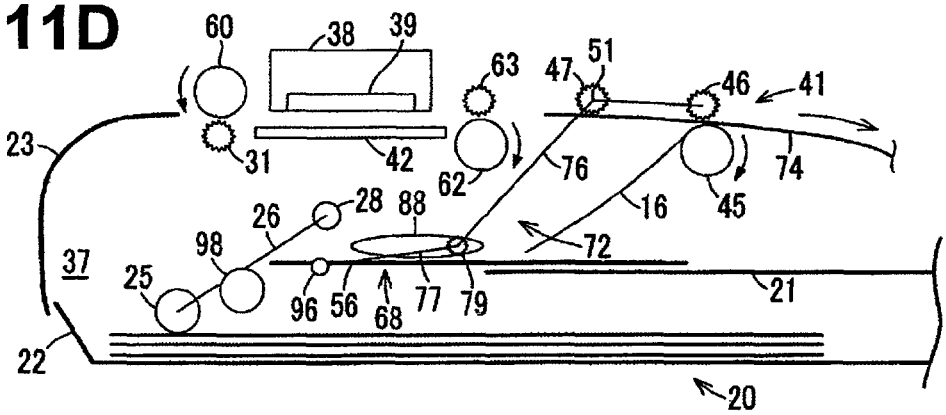

After recording sheet 74 is sent out from second conveying path 68 to first conveying path 23, path changing unit 41 may change from the second position to the first position, as shown in FIGS. 11B and 11C. The positional change of path changing unit 41 may cause guide member 56 to move, such that guide member 56 may separate from arm 26, which may cause arm 26 to change from the fourth position to the third position, as shown in FIGS. 11B and 11C. Recording sheet 74, now having the images recorded on both sides, may be discharged from first conveying path 23 to discharge tray 21 by forward rotation of the rollers 45 and 46, as shown in FIG. 11D.

While arm 26 is maintained in the fourth position, recording sheet 74, guided in the second conveying path 56, may be fed to the upstream side of recording unit 24 in first conveying path 23 by supply roller 98. In an embodiment of the invention, supply guide roller 96 may be removed. Feed roller 25 and recording sheet 74, fed from second conveying path 56 to the upstream side of recording unit 24 in first conveying path 23 by supply roller 98, do not contact each other. Feed roller 25 therefore may avoid collecting ink from recording sheet 74.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A recording device comprising:

a feed tray configured to store a sheet stack;

a first conveying mechanism configured to convey a sheet from the sheet stack along a first conveying path in a first direction;

an arm having a first end and a second end opposite the first end, wherein the first end of the arm is attached to a predetermined pivot and the arm is configured to swing about the predetermined pivot;

a feed roller rotatably attached to the second end of the arm and configured to feed the sheet from the feed tray to the first conveying path;

a recording unit disposed along the first conveying path and configured to record an image onto the sheet as the conveying mechanism conveys the sheet along the first conveying path;

a second conveying mechanism configured to guide the sheet in a second direction, along a second conveying path defined between the predetermined pivot and the feed tray, to an upstream side of the recording unit in the first direction; and a path changing unit disposed at a downstream side of the recording unit in the first direction and configured to move selectively between a first position in which the path changing unit is configured to discharge the sheet and a second position in which the path changing unit is configured to convey the sheet to the second conveying path, wherein the arm is configured to selectively move between a third position, in which the feed roller contacts the sheet stack in the feed tray, and a fourth position, in which the feed roller is disposed above the second conveying path, wherein the first direction is substantially opposite to the second direction, and wherein the recording device further comprises a link mechanism configured to mechanically link the path changing unit to the arm, such that the arm is configured to move between the third position and the fourth position in response to the movement of the path changing unit between the first position and the second position.

2. The recording device according to claim 1, wherein the first conveying path comprises an arcuate portion configured to redirect a path of the sheet toward the recording unit to form a U-turn.

3. The recording device according to claim 1, wherein the sheet comprises a particular edge, and the first conveying mechanism is configured to convey the sheet along the first conveying path with the particular edge as a leading edge, and the second conveying mechanism is configured to convey the sheet along the second conveying path with the particular edge as a trailing edge.

4. The recording device according to claim 1, wherein the link mechanism comprises an arm link member that connects the path changing unit to the arm, such that when the path changing unit moves between the first position and the second position, the arm moves between the third position and the fourth position.

5. The recording device according to claim 1, wherein the second conveying mechanism comprises a pair of rollers configured to nip the sheet guided along the second conveying path, and configured to feed the sheet to the upstream side of the recording unit.

6. The recording device according to claim 1, further comprising a discharge tray configured to receive the sheet that is discharged after passing the recording unit, wherein the second conveying mechanism comprises a guide member supported by the discharge tray and extending above the feed tray.

7. The recording device according to claim 6, wherein the discharge tray is disposed above the feed tray.

* * * * *